US008931139B2

(12) United States Patent
Saito

(10) Patent No.: US 8,931,139 B2
(45) Date of Patent: Jan. 13, 2015

(54) MOVING DEVICE FOR MOVING MOVABLE BODY

(75) Inventor: Norio Saito, Fujisawa (JP)

(73) Assignee: Nifco Inc., Yokohama-shi, Kanagawa (JP)

( * ) Notice: Subject to any disclaimer, the term of this patent is extended or adjusted under 35 U.S.C. 154(b) by 0 days.

(21) Appl. No.: 14/112,136

(22) PCT Filed: Apr. 18, 2012

(86) PCT No.: PCT/JP2012/060489
§ 371 (c)(1),
(2), (4) Date: Oct. 29, 2013

(87) PCT Pub. No.: WO2012/144529
PCT Pub. Date: Oct. 26, 2012

(65) Prior Publication Data

US 2014/0059801 A1 Mar. 6, 2014

(30) Foreign Application Priority Data

Apr. 19, 2011 (JP) ..... 2011-093253

(51) Int. Cl.
*E05F 1/08* (2006.01)
*E05F 1/16* (2006.01)
(Continued)

(52) U.S. Cl.
CPC . *E05F 1/16* (2013.01); *E05F 5/027* (2013.01); *E05F 5/02* (2013.01); *E05F 5/003* (2013.01)
USPC ..... 16/72; 16/49; 49/358; 49/421

(58) Field of Classification Search
USPC ..... 16/49, 71, 72, 76, 85; 49/358, 360, 409, 49/414, 421, 275, 364, 379
See application file for complete search history.

(56) References Cited

U.S. PATENT DOCUMENTS 8,272,165 B2 * 9/2012 Tomioka ..... 49/275
8,272,166 B2 * 9/2012 Nezu ..... 49/358
2007/0132346 A1 6/2007 Huang
(Continued)

FOREIGN PATENT DOCUMENTS

DE 202010003932 U1 7/2010
JP 2006-169723 A 6/2006
(Continued)

OTHER PUBLICATIONS

Europe Patent Office, "Search Report for EP12773921.7," Oct. 2, 2014.

*Primary Examiner* — William Miller
(74) *Attorney, Agent, or Firm* — Manabu Kanesaka

(57) ABSTRACT

A movable device for a movable body has a reception body fixed to a support body or the movable body relatively moving to the support body, and includes a plurality of engagement portions protruding from the support body or the movable body by being separated from each other; a base body provided in the other of the support body or movable body; an abutment body formed to move along a movement direction of the movable body, and engaging one of the engagement portions in a case wherein the movable body moves in a movement completion position thereof; and an urging mechanism formed urgingly between the base body and the abutment body, restricting a movement of the base body or abutment body by urging, and releasing restriction of the movement by engagement of the abutment body with one of engagement portions.

3 Claims, 9 Drawing Sheets

(51) Int. Cl.
*E05F 5/02* (2006.01)
*E05F 5/00* (2006.01)

(56) References Cited

U.S. PATENT DOCUMENTS

2007/0186481 A1* 8/2007 Tomita et al. ..... 49/409
2011/0041284 A1* 2/2011 Kimura et al. ..... 16/49
2011/0271482 A1* 11/2011 Nezu ..... 16/49
2014/0026358 A1* 1/2014 Saito ..... 16/72
2014/0033475 A1* 2/2014 Saito ..... 16/49

FOREIGN PATENT DOCUMENTS

JP 2008-285933 A 11/2008
WO 2011/007735 A1 1/2011

* cited by examiner

MOVING DEVICE FOR MOVING MOVABLE BODY

RELATED APPLICATIONS

The present application is National Phase of International Application No. PCT/JP2012/060489 filed Apr. 18, 2012, and claims priority from Japanese Application No. 2011-093253, filed Apr. 19, 2011.

FIELD OF TECHNOLOGY

The present invention relates to a movable device for a movable body assisting an operation of the movable body.

BACKGROUND ART

In order to assist the operation of the movable body such as a sliding door and the like allowing a support body such as a door frame and the like to move, there is known a movable device for a movable body called a closer and the like, and forcedly moving the movable body using an urging mechanism. In the movable device for the movable body, in either one of a support body side or a movable body side, there is provided a reception body called a striker, and in the other either support body side or movable body side, there is provided an abutment body formed by a resin material and the like, and formed to be engageable with the reception body. The abutment body is provided in a base body to extend and fixed in the other either support body or movable body along a slide direction of the movable body so as to be movable along the slide direction. Also, the abutment body is connected to the base body through an urging member such as a tension coil spring and the like.

Such movable device for the movable body is held in a state wherein the abutment body extends the tension coil spring most when the movable body is in a position other than a movement completion position thereof. From that position, when an operator moves the movable body toward the movement completion position, the abutment body collides with the reception body on the way of a movement so as to be engaged with the reception body. Simultaneously, the holding of the abutment body is released, and the abutment body is pulled by the tension coil spring in a state engaged with the reception body so as to move relative to the base body.

The reception body and the base body are respectively provided in either the support body or the movable body, so that the abutment body in the state engaged with the reception body moves relative to the base body. Accordingly, the movable body forcedly moves toward the movement completion position relative to the support body.

Incidentally, when the movable body is in the movement completion position, the abutment body becomes a state wherein the tension coil spring is compressed, and the state engaged with the reception body. When an operator moves the movable body toward an open position from a closed position, the movable body moves while pulling the tension coil spring. When the movable body reaches a predetermined position, the abutment body and the reception body are disengaged, and the abutment body is held again in the state wherein the abutment body extends the tension coil spring most.

However, in the movable device for the movable body, even in a case wherein the movable body is positioned in other than the movement completion position of the movable body by various factors, there is a case wherein the abutment body comes to an improper actuation state, which becomes the state wherein the tension coil spring is compressed without the abutment body being engaged with the reception body.

Consequently, as for a mechanism restoring from the improper actuation state, there is provided an oblique guide face in the abutment body, and the abutment body is turned by applying a pressure to a downward direction which recedes from the reception body by abutting against the reception body, so that the reception body and the abutment body are engaged with each other (for example, see Patent Document 1).

In the movable device, the abutment body is configured in a predetermined shape so as to be re-engaged with the reception body by turning around an axis, and there is formed a frame body housing the abutment body in such a way as to be elastically deformed downwardly. Also, there is provided a gap allowing a deformation of the frame body.

Also, since the reception body is formed in a cylindrical shape and the like, there is only one position wherein an engagement portion is engaged with the reception body. Consequently, it is necessary to provide a locking portion, which only corresponds at an improper actuation time, in the abutment body separately from the engagement portion. Such locking portion is formed so as to be automatically restorable by elastically deforming in such a way as to be unlocked from the reception body.

PRIOR ART DOCUMENTS

Patent Documents

Patent Document 1: Japanese Unexamined Patent Application Publication No. 2006-169723

DISCLOSURE OF THE INVENTION

Problems to be Solved by the Invention

In the aforementioned technology, there are problems described hereinafter. Namely, the aforementioned technology has a configuration allowing the abutment body to turn while the axis is being fixed so as to deform a component and to require a complicated measurement setup. Also, the locking portion is required to have a configuration which can elastically deform so as to be made of the resin material, and by an elastic force of the resin material, in many cases, the reception body and the locking portion are automatically released. However, the resin material is required to be used in consideration of fatigue or an aging change. Consequently, even if a material does not have a high elastic force such as the resin material and the like, there is required a movable member which is automatically restorable.

Also, in a configuration providing the locking portion, which only corresponds at the improper actuation time, separately from the engagement portion, a shape of the abutment body becomes complicated so as to cause the problem that a whole length of the movable device is long and the like.

Therefore, an object of the present invention is to provide a movable device for a movable body including the abutment body and the reception body, which is automatically restorable at the improper actuation time, with a simple configuration regardless of a use material.

Means for Solving the Problems

In order to solve the aforementioned problems, and to obtain the aforementioned object, the present invention provides a movable device for a movable body, comprising a reception body fixed in either one of a support body or the movable body relatively moving to the support body, and including a plurality of engagement portions protruding from either one of the support body or the movable body by being separated from each other; a base body provided in the other either support body or movable body; an abutment body provided in the base body to be movable along a movement direction of the movable body, and engaging with either of the plurality of engagement portions in a case wherein the movable body moves in a movement completion position thereof; and an urging mechanism formed between the base body and the abutment body to be urged, restricting a movement of the base body or the abutment body by the urging, and engaging the abutment body with either of the plurality of engagement portions so as to release restriction of the movement of the base body or the abutment body.

Effect of the Invention

According to the present invention, the movable device for the movable body including the abutment body and the reception body, which is automatically restorable at the improper actuation time, can be provided with the simple configuration regardless of the use material.

BEST MODES OF CARRYING OUT THE INVENTION

Hereinafter, a movable device 1 for a movable body 110 according to one embodiment of the present invention will be explained with reference to FIG. 1 to FIG. 7.

Figure 1:
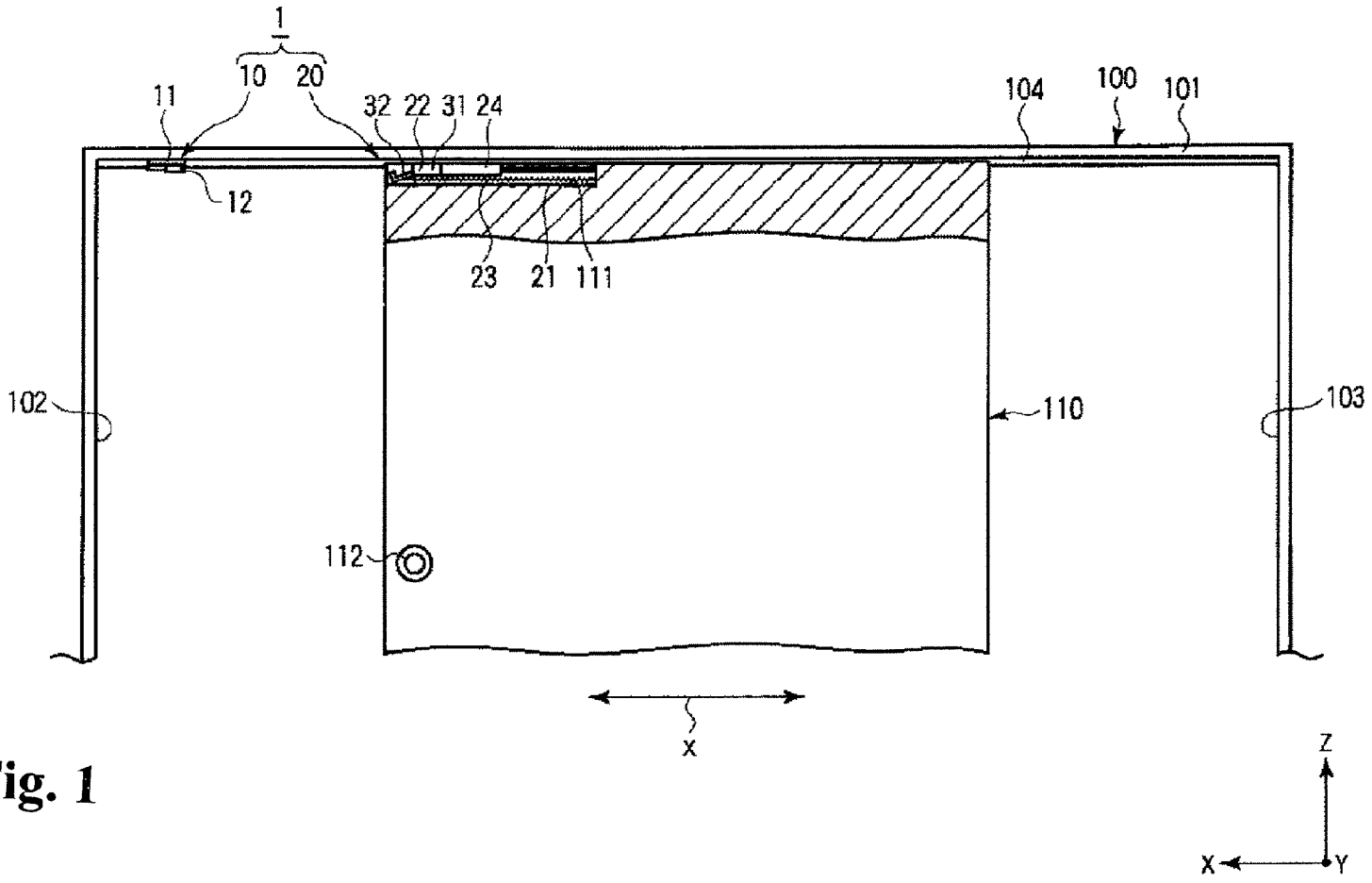
FIG. 1 is an explanatory view schematically showing a configuration of a movable device used for a support body and a movable body according to one embodiment of the present invention.
Figure 2:
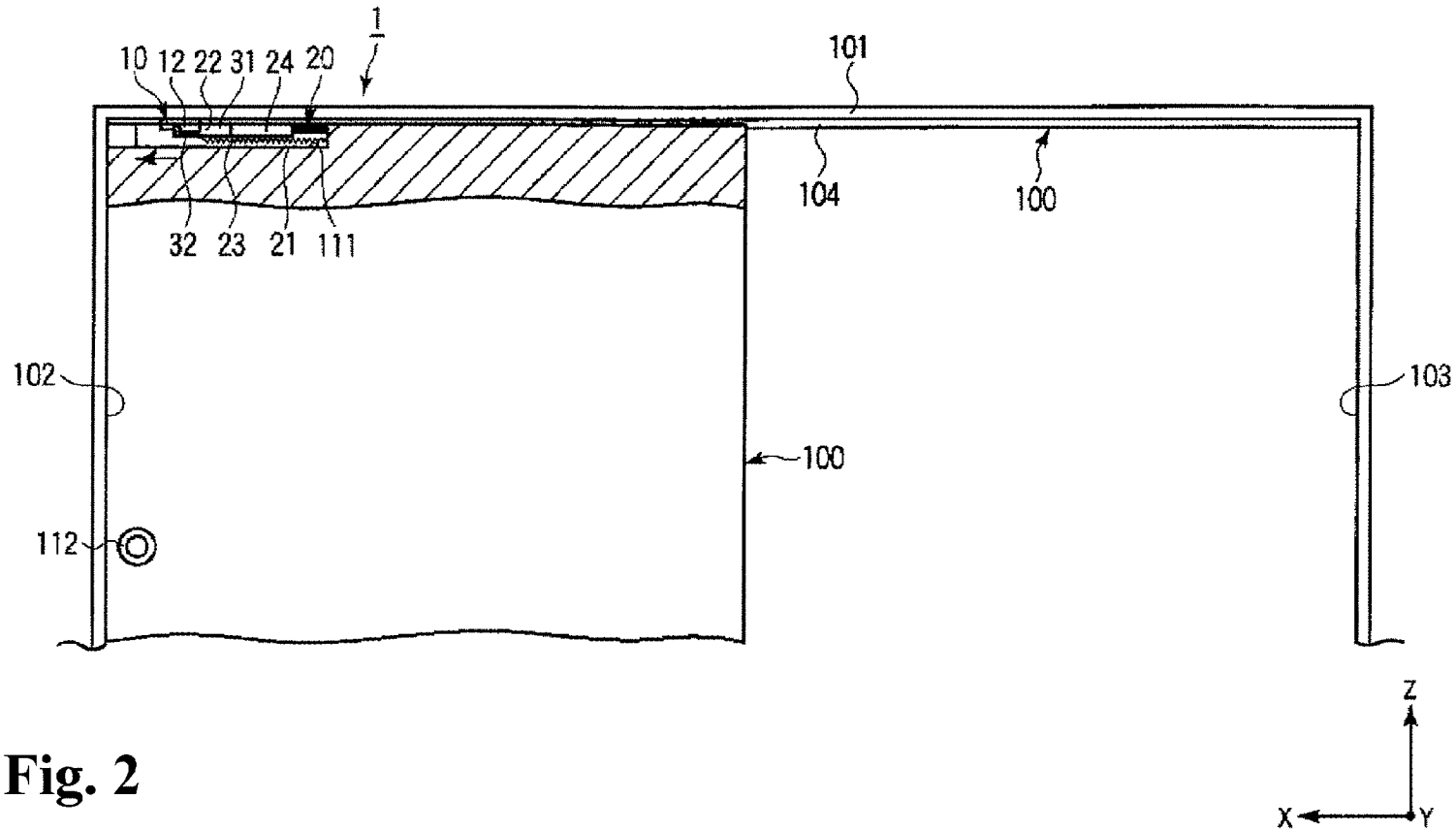
FIG. 2 is an explanatory view schematically showing an operation of the movable body by the movable device.
Figure 3:
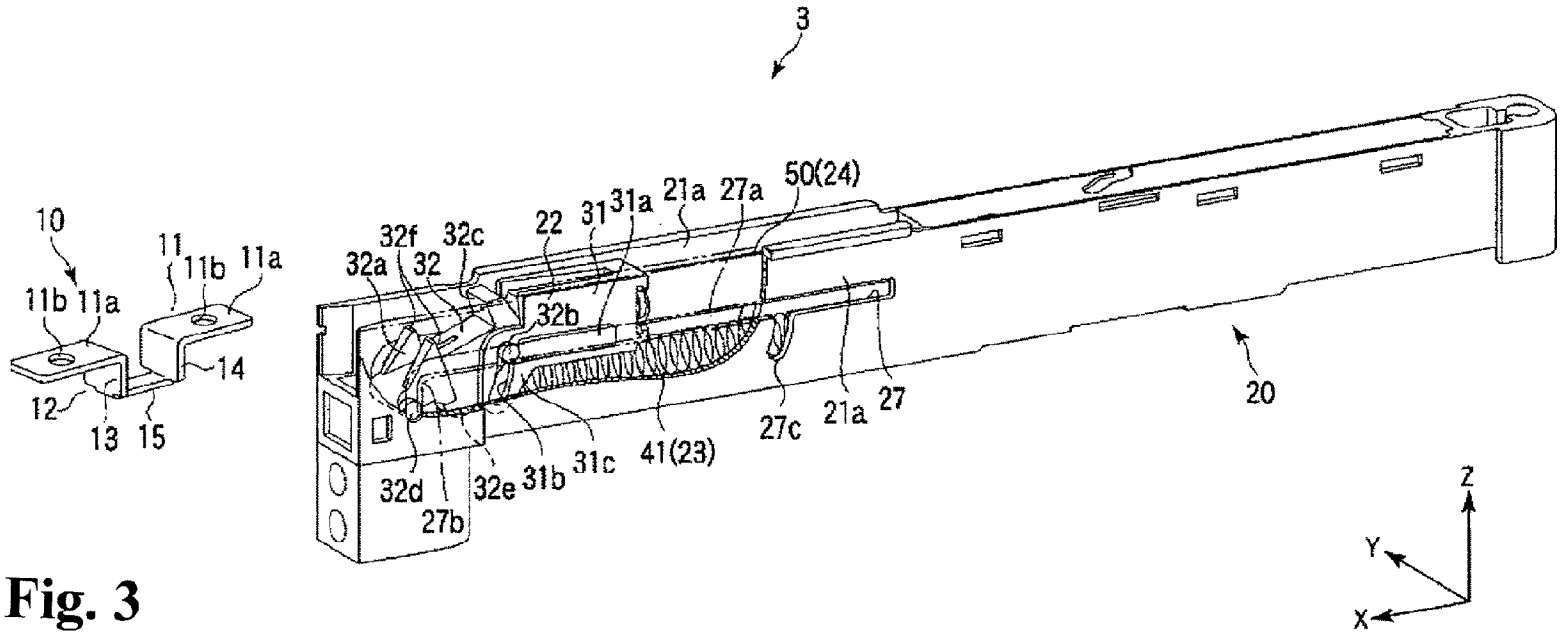
FIG. 3 is a perspective view showing the configuration of the movable device by cutting one portion out.
Figure 4:
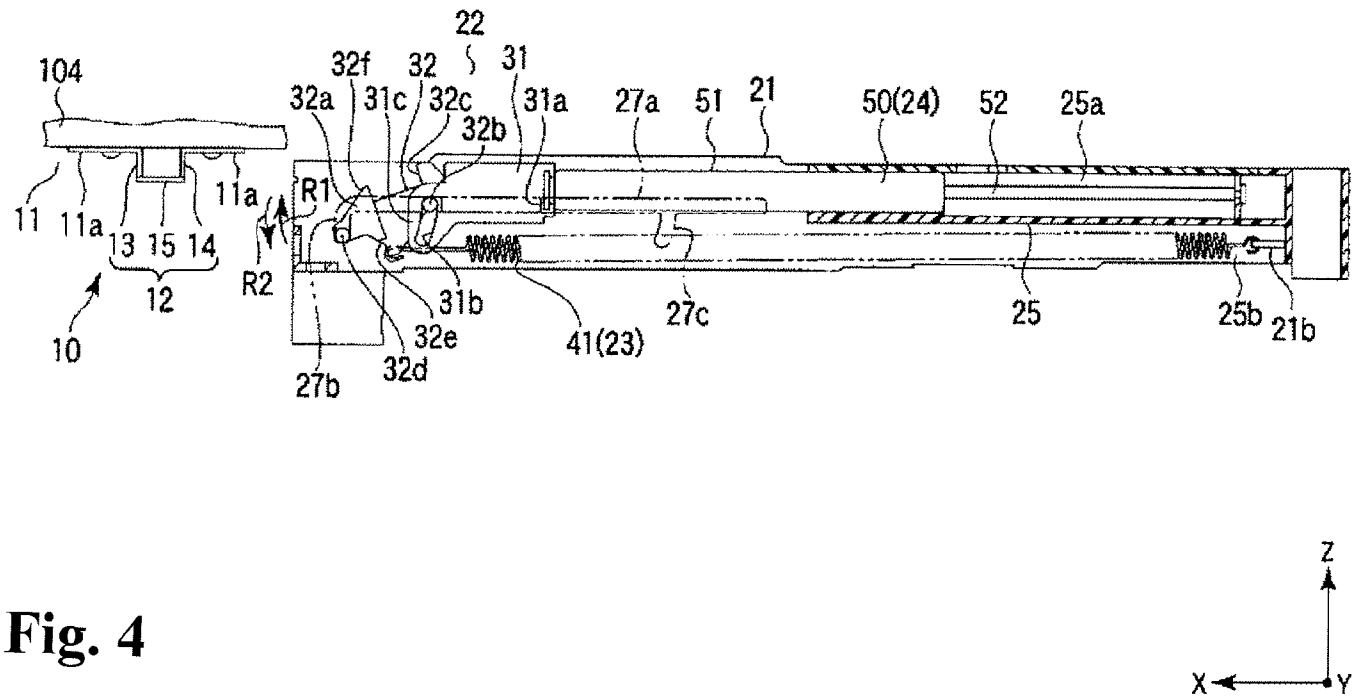
FIG. 4 is a side view showing the configuration of the movable device by cutting one portion out.
Figure 5:
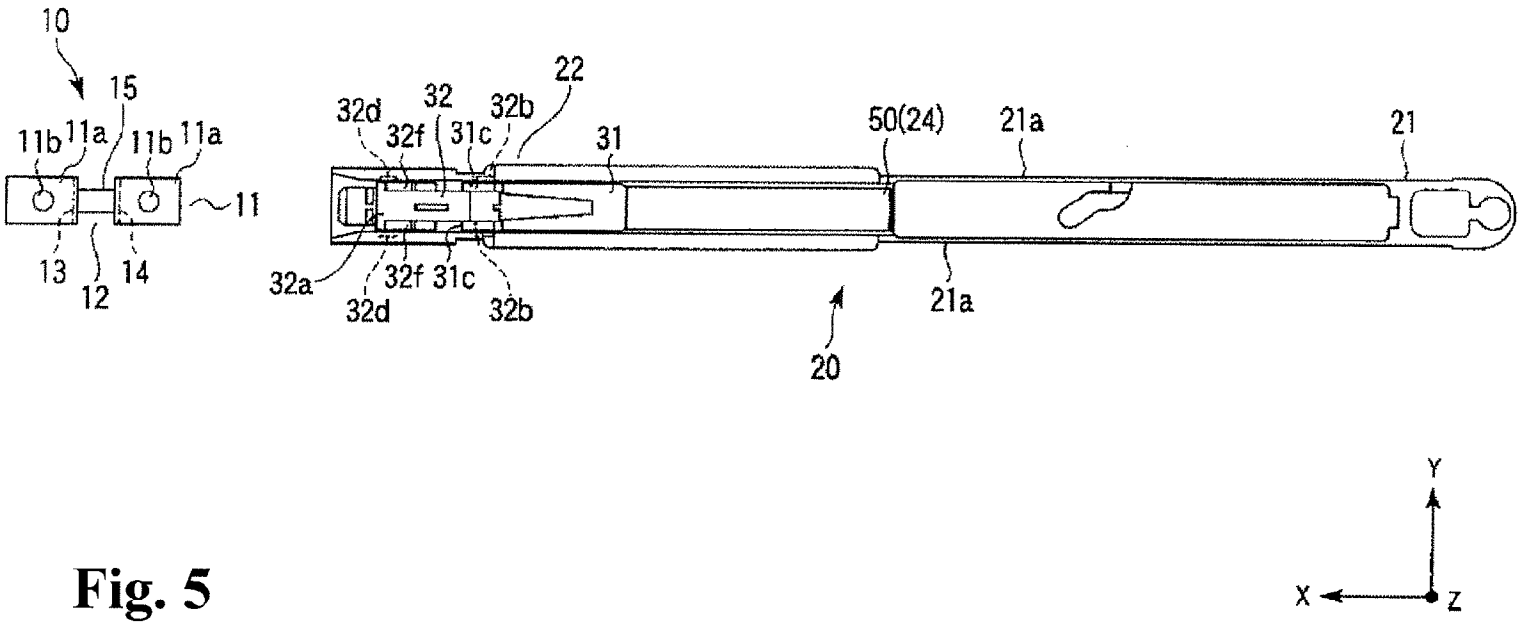
FIG. 5 is a top view showing the configuration of the movable device.
Figure 6:
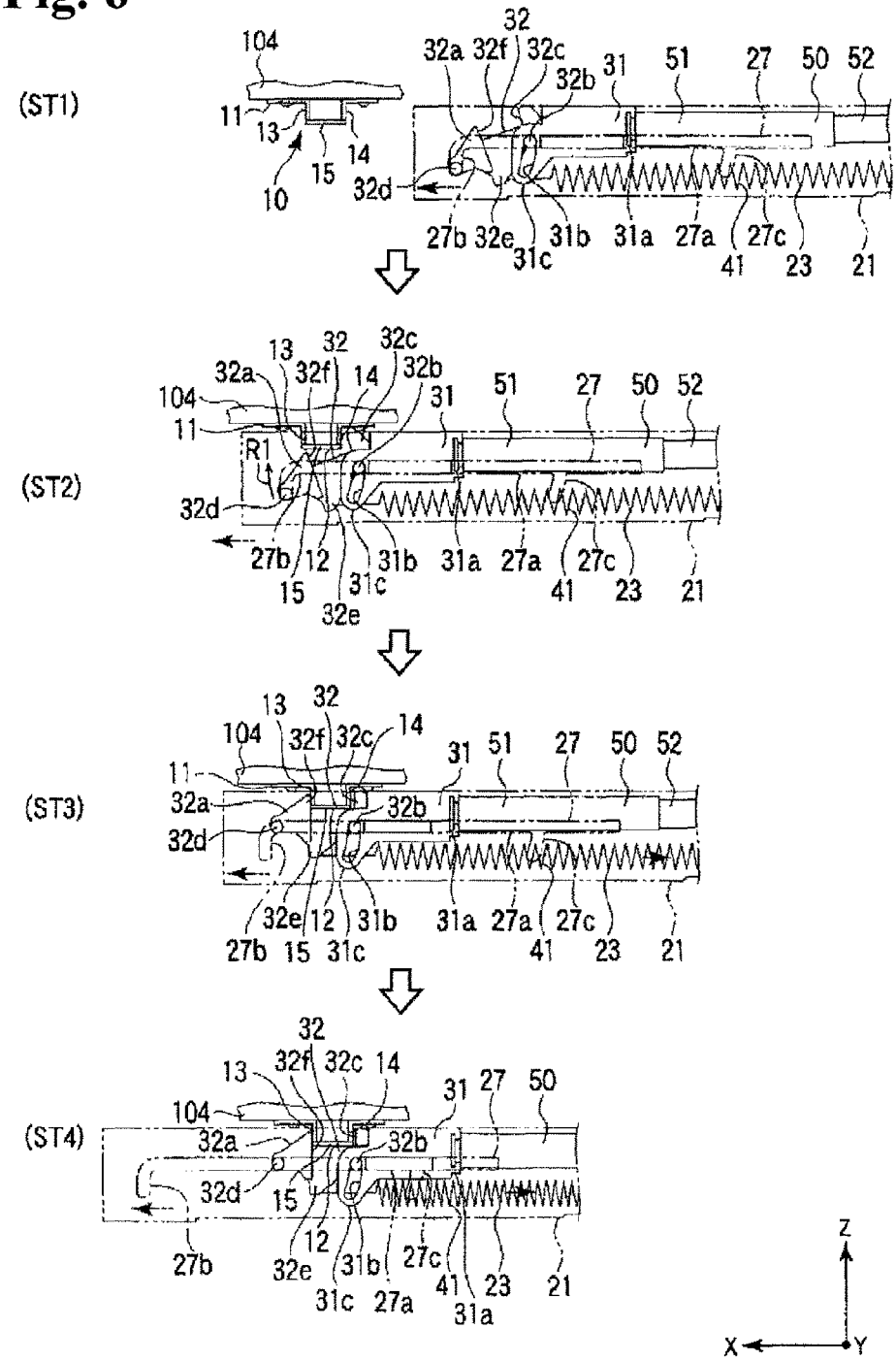
FIG. 6 is an explanatory view showing operations of the movable device at a normal time.
Figure 7:
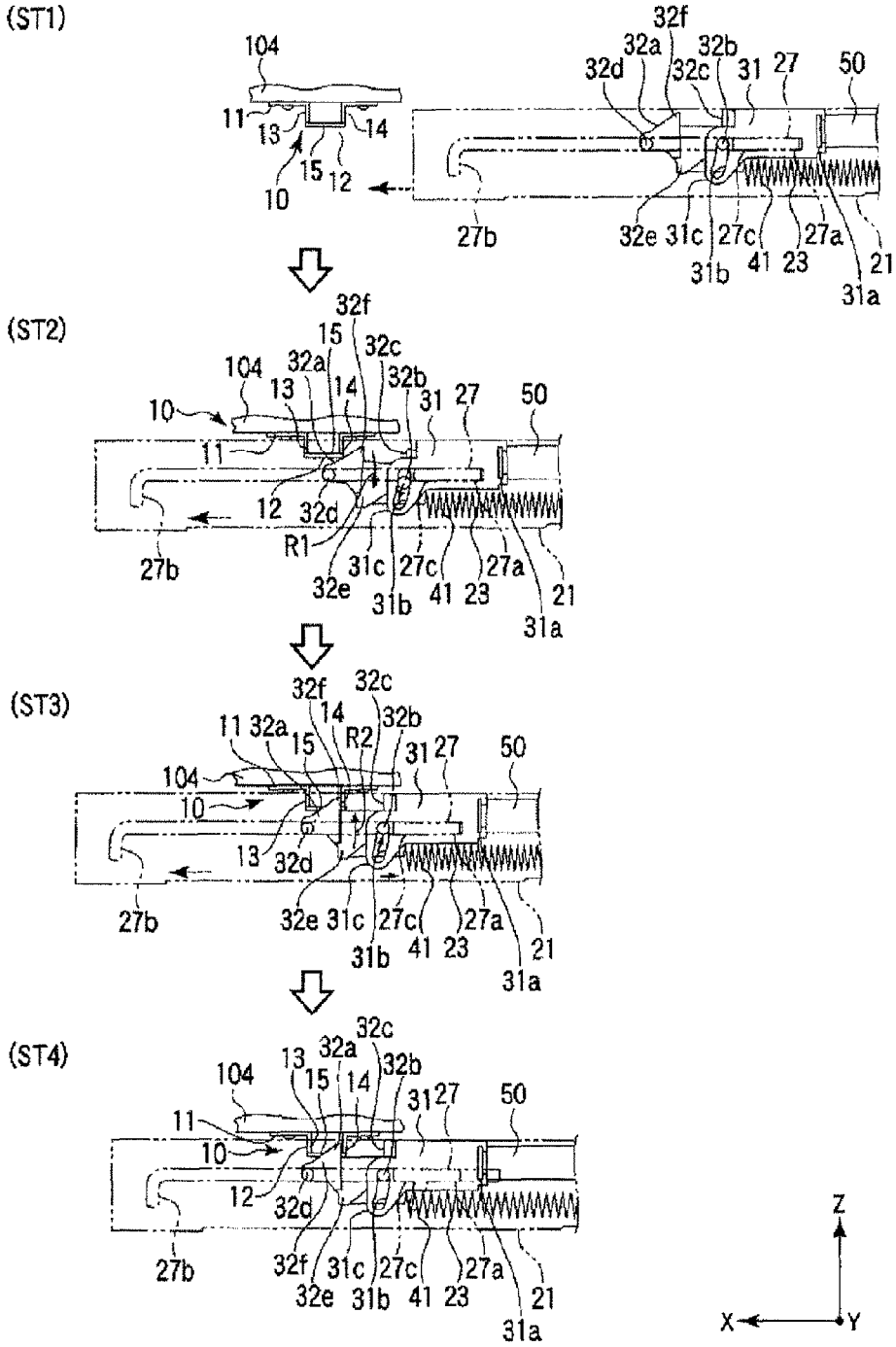
FIG. 7 is an explanatory view showing operations of the movable device at an improper actuation time.

FIG. 1 is an explanatory view schematically showing a configuration of the movable device 1 provided in a support body 100 and the movable body 110 according to one embodiment of the present invention. FIG. 2 is an explanatory view schematically showing an operation of the movable body 110 by the movable device 1. FIG. 3 is a perspective view showing the configuration of the movable device 1 by cutting one portion out. FIG. 4 is a side view showing the configuration of the movable device 1 by cutting one portion out. FIG. 5 is a top view showing the configuration of the movable device 1. FIG. 6 is an explanatory view showing operations of the movable device 1 at a normal time. FIG. 7 is an explanatory view showing operations of the movable device 1 at an improper actuation time.

Incidentally, in FIG. 1 to FIG. 7, arrows X, Y, and Z represent three directions respectively orthogonal to each other. Incidentally, an X direction represents a slide direction of the movable body 110, a Y direction represents a thickness direction of the movable body 110, and a Z direction represents an up-and-down direction.

As shown in FIG. 1 and FIG. 2, the movable device 1 is a so-called closer provided in the support body 100 and the movable body 110, and assisting a movement of the movable body 110. The movable device 1 comprises a striker 10 provided in either one of the support body 100 or the movable body 110; and an assist unit 20 provided in either the other support body 100 or movable body 110. In the present embodiment, a configuration wherein the striker 10 is provided in the support body 100, and the assist unit 20 is provided in the movable body 110 will be explained.

Incidentally, in the present embodiment, for example, the support body 100 is a door frame, and the movable body 110 is a sliding door. Hereinafter, the support body 100 will be explained as the door frame 100, and the movable body 110 will be explained as the sliding door 110.

As shown in FIG. 1, the door frame 100 comprises an upper frame 101, a left frame 102, a right frame 103, and a lower frame. In the upper frame 101, there is formed a sliding-door groove 104 taken along the slide direction of the sliding door 110, and in the sliding-door groove 104, there is slidably housed the sliding door 110.

In an upper end portion of the sliding door 110, there is formed a groove 111 in which the assist unit 20 is housed along the slide direction. Incidentally, here, focusing one sliding door 110, the left side is a door fore-end side, and the right side is a door back-end side. Also, a position wherein the sliding door 110 abuts against the left frame 102 is a movement completion position of the sliding door 110. In a left end portion which is the door fore-end side of the sliding door 110, there is formed a knob 112.

As shown in FIG. 1, an open state wherein the sliding door 110 has not reached the movement completion position (has positioned other than in the movement completion position) is a first state. Also, as shown in FIG. 2, a closed state wherein the sliding door 110 has moved to the movement completion position on the door fore-end side so as to abut against the left frame 102 is a second state.

The striker 10 is a reception body. As shown in FIG. 1 and FIG. 2, the striker 10 is fixed in the sliding-door groove 104 of the upper frame 101, and in a given position from the movement completion position on the door fore-end side of the sliding door 110.

The striker 10 includes an attachment member 11 having a plate shape and attached to the upper frame 101; and an engagement protrusion 12 provided along the Y direction and the Z direction from the attachment member 11, having two different face shapes which are separated in the X direction, and protruding downward from the upper frame 101. The striker 10 is made such that the attachment member 11 and the engagement protrusion 12 are bent by a sheet-metal processing and the like of one sheet of a plate-like metal plate.

The attachment member 11 includes a pair of bases 11*a* having a flat plate shape; and hole portions 11*b* provided on the bases 11*a*, and fixing the bases 11*a* in the upper frame 101 by fastener member such as a wooden screw and the like.

The engagement protrusion 12 is provided in the bases 11*a* in such a way as to bridge the pair of bases 11*a*. Specifically, the engagement protrusion 12 is formed in a "U" shape whose upper side is open in a side view from the Y direction, and end portions thereof are connected to the bases 11*a*. The engagement protrusion 12 is formed such that by the movement of the sliding door 110, the engagement protrusion 12 passes through on the groove 111 of the sliding door 110, and is engaged with one portion of the assist unit 20 so as to enter into the assist unit 20, or the engagement protrusion 12 can be released from one portion of the assist unit 20.

The engagement protrusion 12 includes a first engagement portion 13 having a plate shape (a face shape) connected to one base 11*a*; a second engagement portion 14 having a plate shape (a face shape) connected to the other base 11*a*; and a connection portion 15 connecting the first engagement portion 13 with the second engagement portion 14.

The first engagement portion 13 has a face connected to the base 11*a* on a movement completion position side of the sliding door 110 between the pair of bases 11*a*, provided to extend in a direction protruding from the sliding-door groove 104 of the upper frame 101, and taken along the Y direction and the Z direction. The first engagement portion 13 engages with one portion of the assist unit 20.

The second engagement portion 14 has a face connected to the other base 11*a*, provided to extend in the direction protruding from the sliding-door groove 104, taken along the Y direction and the Z direction, and having approximately the same shape as the first engagement portion 13. The second engagement portion 14 engages with one portion of the assist unit 20.

More specifically, in the second engagement portion 14, a main face on a side facing the first engagement portion 13, which is one main face, forms an engagement face abutting against and engaging with a hook portion 32*f* of the later-mentioned latch 22. Also, the other main face thereof forms a pressing face pressing the later-mentioned pressed portion 32*c*. The second engagement portion 14 is disposed in the slide direction more than the first engagement portion 13, and is disposed by being separated from the movement completion position (the left frame 102) of the sliding door 110.

The connection portion 15 connects the first engagement portion 13 with the second engagement portion 14, and a width in the Y direction thereof is formed smaller than a width in the Y direction of the first engagement portion 13 and the second engagement portion 14. The connection portion 15 is disposed in a lower end of the first engagement portion 13 and the second engagement portion 14, and is disposed approximately in the center in the Y direction of the first engagement portion 13 and the second engagement portion 14. The connection portion 15 is formed to pass through the hook portion 32*f* of the later-described latch 22.

The assist unit 20 is provided in the groove 111 of the upper end portion of the sliding door 110. The assist unit 20 includes a housing 21, the latch 22, an urging mechanism 23, and a damping mechanism 24.

The housing 21 is a base body formed by a resin material, and fixed in the groove 111 of the sliding door 110. As shown in FIG. 3 to FIG. 5, the housing 21 is formed in a slender box shape in the slide direction, whose upper face on one side thereof (the left side in FIG. 1 to FIG. 5) is open. Incidentally, here, one side represents the movement completion position (the left frame 102) side of the sliding door 110.

The housing 21 includes a pair of side walls 21*a* and 21*a* provided by being separated in the Y direction, and opens in the Z direction in one side thereof. Also, on the other side (the right side in FIG. 1 to FIG. 5), there is provided a divider plate 25 at the center in the Z direction so as to form an upper portion chamber 25*a* on an upper side, and a lower portion chamber 25*b* on a lower side. Namely, the housing 21 opens one side of the upper portion chamber 25*a*, and is formed so as to house the latch 22 between the side walls 21*a* and 21*a*.

The side walls 21*a* and 21*a* of the housing 21 include slits 27 having the same shape and facing each other, on one side of the side walls 21*a* and 21*a*. The slit 27 includes a main guide route 27*a* extending along an X axis; a standby route 27*b* extending downward by curving from an end portion (one end portion) on the movement completion position side of the main guide pathway 27*a*; and an escape route 27*c* extending by diverging from a mid-course portion on the other end portion side of the main guide route 27*a*, and curving in an arc shape downward and toward one side. In the slit 27, the main guide route 27*a*, the standby route 27*b*, and the escape route 27*c* are continuously formed.

Incidentally, one end side of the slit 27 is a standby position (the first position) wherein the latch 22 is positioned in the standby state in which the latch 22 is not engaged with the striker 10. Also, the other end side of the slit 27 is a retraction position (a second position) wherein the latch 22 is positioned in which the latch 22 and the striker 10 are engaged, and the sliding door 110 has been moved. Incidentally, at the later-described improper actuation time, the latch 22 is positioned in the retraction position even if the latch 22 is not engaged with the striker 10.

In the lower portion chamber 25*b* of the housing 21, there is formed a connection portion 21*b* fixing one portion of the urging mechanism 23 in the housing 21. For example, the connection portion 21*b* is an axis-like member bridged between the side walls 21*a* and 21*a*.

The latch 22 is an abutment body abutting against the striker 10. The latch 22 is housed in an end portion on one side (the left side in FIG. 1) in the slide direction between the side walls 21*a* and 21*a* of the housing 21, and is supported in the housing 21 to be slidable between the standby position and the retraction position.

Specifically, as shown in FIG. 3 to FIG. 5, the latch 22 includes a latch base 31, and a cam portion 32 turnably connected to a tip portion of the latch base 31.

The latch base 31 includes a protrusion 31*a* provided to extend along the X direction on a side face thereof. The protrusion 31*a* is formed to be insertable into the slit 27. The latch base 31 is held between the pair of side walls 21*a* and 21*a* to be slidable along the slit 27 by inserting the protrusion 31*a* into the slit 27. In the tip portion of the latch base 31, there is provided a support piece 31*c* including a groove 31*b* opening in an arc shape along the escape route 27*c*.

The cam portion 32 includes a pair of first axis portions 32*b* whose axis center is disposed along the Y direction, and protruding in the Y direction. The first axis portion 32*b* is inserted to pass through the slit 27 and the groove 31*b*. The cam portion 32 is formed to be movable inside the slit 27 by the first axis portion 32*b* inserted into the slit 27 and the groove 31*b*, and to be turnable around the first axis portion 32*b*.

Incidentally, the turning of the cam portion 32 will be explained hereinafter by calling a direction wherein a tip of the cam portion 32 turns upward around the first axis portion 32*b* as a first turning direction R1, and by calling a direction wherein the tip of the cam portion 32 turns downward with the central focus on the first axis portion 32*b* as a second turning direction R2.

In an outer circumferential portion thereof, the cam portion 32 includes a catcher 32*a*, the pressed portion 32*c*, an urged portion 32*e*, and a pair of second axis portions 32*d* in that order clockwise from a tip upper side thereof in a side view shown in FIG. 4.

The catcher 32*a* is provided in a tip side of the cam portion 32, and includes a pair of hook portions 32*f* protruding to an upper side of the cam portion 32. The hook portion 32*f* is respectively provided on both sides in the Y direction, and has a triangular plate-like member.

The pressed portion 32*c* is formed to protrude upward in an upper portion of the cam portion 32, and abuts against the second engagement portion 14 of the striker 10 by the movement of the sliding door 110 so as to be pressed in a retraction direction. Incidentally, an interval between the pressed portion 32*c* and the hook portion 32*f* is formed to have approximately the same width or above as a width between the first engagement portion 13 and the second engagement portion 14 so as to be capable of capturing the engagement protrusion 12.

The pair of second axis portions 32*d* is formed in the catcher 32*a* to protrude in the Y direction, and includes an axis center along the Y direction. The second axis portion 32*d* is inserted to pass through the slit 27, and is movably engaged inside the slit 27.

The urged portion 32*e* is provided in a lower portion of the cam portion 32, and is positioned on a pressed portion 32*c* side more than the second axis portion 32*d* in the X direction, and on a lower side of the second axis portion 32*d*. The urged portion 32*e* is disposed in a lower portion of the housing 21, and is connected to one end 41*a* of the later-described tension coil spring 41 of the urging mechanism 23. By the tension coil spring 41, the urged portion 32*e* is constantly pulled in the retraction direction.

The urging mechanism 23 urges the latch 22 to the other side in the slide direction relative to the housing 21, and restricts the movement of the latch 22 by the aforementioned urging. The urging mechanism 23 is configured by the tension coil spring 41, which is an urging device, the second axis portion 32*d* restricting the movement of the cam portion 32 by the urging of the tension coil spring 41, and the slit 27.

Namely, the urging mechanism 23 urges the cam portion 32 by the tension coil spring 41, and the second axis portion 32*d* is positioned in the standby route 27*b* so, as to restrict the movement of the cam portion 32. Also, the cam portion 32 is engaged with the first engagement portion 13, and the cam portion 32 turns, so that the second axis portion 32*d* is positioned in the main guide route 27*a* so as to release the restriction of the movement of the cam portion 32. In the tension coil spring 41, in the lower portion of the housing 21, an axis center direction thereof is disposed along the slide direction.

One end of the tension coil spring 41 is connected to the urged portion 32*e* of a lower portion of the latch 22, and the other end is connected to the connection portion 21*b* of the housing 21. The tension coil spring 41 has a function allowing the latch 22 to be held by being hooked in the standby route 27*b* by urging the latch 22, which is in the standby state, in the retraction direction; a function forcedly moving the latch 22, which is in the main guide route 27*a*, by urging the latch 22 in the retraction direction; and a function urging the latch 22 in the second turning direction R2.

The damping mechanism 24 is connected to the latch 22, and provides a resistance force to a slide movement of the latch 22 so as to interfere. The damping mechanism 24 is a piston damper 50 provided inside the upper portion chamber 25*a* of the housing 21. The piston damper 50 includes a cylinder 51 in which a fluid is enclosed; a piston reciprocating along the X direction inside the cylinder 51; and a piston rod 52 connected to the piston.

An end portion of the piston rod 52 is fixed in the housing 21, and an outside end portion of the cylinder 51 facing the piston is connected to a back end of the latch 22.

The damping mechanism 24 activates the fluid inside the cylinder 51 to be opposed to an operation of the piston housed inside the cylinder 51 so as to provide the resistance force relative to push-in and pulling operations of the cylinder 51 or the piston rod 52, and to damp a slide operation of the latch 22 relative to the housing 21. Incidentally, in the cylinder 51, a viscous fluid such as silicone oil and the like is used as the enclosed fluid. However, the enclosed fluid is not limited to the viscous fluid, and a gas may be used.

According to the movable device 1 configured as above, at a first operation wherein the striker 10 and the assist unit 20 are engaged in a case in which the sliding door 110 has moved from the first state to the second state at the normal time; and a second operation wherein an engagement between the striker 10 and the assist unit 20 is released in a case in which the sliding door 110 has moved from the second state to the first state, the hook portion 32*f* of the latch 22 enters the first engagement portion 13, or is detached from the first engagement portion 13, and the engagement protrusion 12 is engaged with the catcher 32*a* so as to release a capture or the engagement.

Also, at a time of a third operation wherein the striker 10 and the assist unit 20 are engaged in a case in which the sliding door 110 has moved from the first state to the second state at an improper actuation recovery time, the pair of plate-like hook portions 32*f* of the latch 22 passes through the connection portion 15 so as to enter between the first engagement portion 13 and the second engagement portion 14. Thereby, the hook portion 32*f* abuts against one main face of the second engagement portion 14, and the second engagement portion is captured by the catcher 32*a*. By the aforementioned engagements, the striker 10 engages the latch 22 so as to move integrally.

Hereinafter, the first operation and the second operation of the movable device 1 according to the present embodiment will be specifically explained using FIG. 1, FIG. 2, FIG. 6, and FIG. 7.

As shown in FIG. 1 and FIG. 6 (ST1), in the first state wherein the sliding door 110 is positioned in a position other than the movement completion position, and the sliding door 110 has not reached the striker 10, the second axis portion 32*d* of the latch 22 is caught on the standby route 27*b*, and is pulled by the tension coil spring 41 so as to be held, and the latch 22 is held in the standby position on one end side of the housing 21.

The first operation turning from the first state to the second state will be explained. An operator moves the sliding door 110 toward the left frame 102 (the movement completion position) from the first state, so that as shown in FIG. 6 (ST2), the sliding door 110 reaches a first predetermined position, and the latch 22 abuts against the striker 10.

Specifically, in the latch 22, since the second axis portion 32*d* is positioned in the standby route 27*b*, the cam portion 32 has turned downward, and the hook portion 32*f* never interferes with the first engagement portion 13 and the second engagement portion 14. Consequently, the other main face of the second engagement portion 14 of the striker 10, which has passed through the hook portion 32*f*, presses the pressed portion 32*c*, so that the cam portion 32 turns in the first turning direction R1 around the first axis portion 32*b*.

Due to the aforementioned turning, as shown in FIG. 6 (ST3), the hook portion 32*f* of the tip of the cam portion 32 engages with the striker 10, and the striker 10 is captured by the latch 22. Also, when the cam portion 32 turns in the first turning direction R1, the second axis portion 32*d* on the lower side moves upward, and reaches a position entering into the main guide route 27*a*, so that the holding into the standby route 27*b* is released. Also, the second axis portion 32*d* comes to a state movable along the main guide route 27*a*.

Then, as shown in FIG. 2 and FIG. 6 (ST4), due to a restoring force of the tension coil spring 41, the latch 22 moves to the other side of the housing 21, and relatively moves up to the retraction position. In other words, since the latch 22 is engaged with the striker 10, due to the restoring force of the tension coil spring 41, the sliding door 110 and the housing 21 are forcedly moved relatively toward one side (the movement completion position) in the slide direction relative to the door frame 100 and the striker 10. At that time, the resistance force is provided by the damping mechanism 24, and the sliding door 110 automatically moves in a closing direction slowly while being buffered.

Next, the second operation turning from the second state shown in FIG. 2 and FIG. 6 (ST 4) to the first state will be explained. The second operation is performed in the order of FIG. 6 (ST4), FIG. 6 (ST3), FIG. 6 (ST2), and FIG. 6 (ST1) in a direction opposite to the aforementioned first operation.

When the sliding door 110 is operated to move to the right side from the second state wherein the sliding door 110 has been completely moved to a completion position on the left side, the sliding door 110 moves to the other side (the right side in FIG. 1 to FIG. 5) while relatively moving to one side relative to the sliding door 110 and the housing 21 remaining to capture the striker 10 by the latch 22 against an urging force of the tension coil spring 41 (FIG. 6 (ST3)). At that time, since the latch 22 is connected to the piston rod 52 of the piston damper 50, the latch 22 receives the resistance force of the fluid inside the cylinder 51 while moving the piston.

When the sliding door 110 reaches a predetermined position, as shown in FIG. 6 (ST2), the striker 10 separates from the pressed portion 32*c*, and by the restoring force of the tension coil spring 41, the cam portion 32 turns in the second turning direction R2 around the second axis portion 32*d*. By the aforementioned turning, the hook portion 32*f* separates from the first engagement portion 13, and an engagement with the striker 10 is released.

At the same time, the second axis portion 32*d* reaches the standby position on one end side of the main guide route 27*a*, and the second axis portion 32*d* enters into the standby route 27*b*. Also, the second axis portion 32*d* returns to the standby state which is held in the standby position again by the tension coil spring 41. After that, the movement of the sliding door 110 is released from the urging force of the tension coil spring 41, and the striker 10 is released so as to return to the first state in FIG. 6 (ST1).

Next, as the third operation, a recovery operation from a third state, wherein the latch 22 has moved to the retraction position without engaging with the striker 10 due to, for example, an improper actuation and the like, will be explained using FIG. 7.

As shown in FIG. 7 (ST1), in a state wherein the engagement with the striker 10 is released, when the sliding door 110 moves toward the movement completion position relative to the door frame 100 from the third state wherein the latch 22 is in the retraction position, as shown in FIG. 7 (ST2), one portion (here, the hook portion 32*f*) of the cam portion 32 abuts against the striker 10 so as to be pressed backward. By the aforementioned pressing, the cam portion 32 sways while turning in the first turning direction R1 while the first axis portion 32*b* is moving downward along the escape route 27*c* around the second axis portion 32*d*.

By the aforementioned swaying, an upper end of the hook portion 32*f* of the catcher 32*a* escapes downward more than the second state, so that the second engagement portion 14 of the striker 10 can climb over the hook portion 32*f*, and moves along the slide direction so as to be movable in the retraction direction up to a position engageable with the latch 22.

As shown in FIG. 7 (ST3), when the second engagement portion 14 of the striker 10 climbs over the hook portion 32*f*, due to the restoring force of the tension coil spring 41, the cam portion 32 turns in the second turning direction R2, and the hook portion 32*f* is inserted to pass through the connection portion 15 so as to be positioned between the first engagement portion 13 and the second engagement portion 14. Accordingly, the striker 10 and the latch 22 are engaged.

In the aforementioned engagement state, when the sliding door 110 is moved toward a direction separating from the movement completion position side, as shown in FIG. 7 (ST4), the striker 10 moves along the main guide route 27*a* in a state captured by the latch 22. Then, when the sliding door 110 reaches the predetermined position, the abutment body and the reception body are disengaged, and the abutment body restores the aforementioned first state held in the standby position.

According to the movable device 1 configured as above, a recovery from an improper actuation state can be obtained, and a damage of a component can be avoided. Also, in the movable device 1, it is not necessary to elastically deform the component at a time of an automatic recovery. Consequently, by forming the striker 10 by a metal material by the sheet-metal processing and the like, the automatic recovery can be carried out with a simple configuration. Also, a high strength can be obtained so as to prevent a damage of the striker 10.

Namely, by a plastic deformation of a plate material of the metal material, the striker 10 forms the first engagement portion 13 and the second engagement portion 14, which are the faces extending in a direction orthogonal to the base 11*a*. Also, the width of the connection portion 15 connecting between the first engagement portion 13 and the second engagement portion 14 is formed to be insertable to pass through the hook portion 32*f* of the cam portion 32, and the width in the Y direction thereof is formed shorter than the width of the first engagement portion 13 and the second engagement portion 14.

Thereby, in the third operation, in a case wherein the second engagement portion 14 has climbed over the hook portion 32*f*, the hook portion 32*f* passes through the connection portion 15, and is positioned between the first engagement portion 13 and the second engagement portion 14. Thereby, the hook portion 32*f* abuts against the main face on one side of the second engagement portion 14 so as to carry out the automatic recovery.

In such striker 10, even though the automatic recovery from the improper actuation state can be carried out, the striker 10 may include a plurality of engagement portions 13 and 14 protruding from the bases 11*a* and 11*a* provided that the hook portion 32*f* is insertable to pass through therebetween.

Also, the cam portion 32 moves along the slit 27, so that the striker 10 is configured to be thinned by the latch 22. Consequently, a high elastic force is not required for the striker 10 and the cam portion 32 so as to be formed by the metal material and the like.

Consequently, the striker 10 may have the simple configuration such that the plurality of engagement portions 13 and 14 protruding from the bases 11*a* and 11*a* is made by the metal material by a processing such as bending and the like. Namely, for the striker 10, one sheet of plate may be only processed by the sheet-metal processing and the like so as to be easily made and to control a manufacturing cost. Also, the striker 10 can be made by the metal material and the like so as to improve a strength thereof, and compared to a case formed by the resin material, the damage of the component due to fatigue and the like can be prevented so as to maintain the operation for a long period.

As mentioned above, with respect to the movable device 1 of the movable body 110 according to one embodiment of the present invention, even though the reception body 10 and the abutment body 22 are formed by a material without the high elastic force such as the resin material and the like, the automatic recovery at the improper actuation time can be carried out with the simple configuration.

Incidentally, the present invention is not limited to the aforementioned embodiment. For example, in the aforementioned example, the connection portion 15 of the striker 10 is disposed in the lower end of the first engagement portion 13 and the second engagement portion 14 with the width shorter than the width of those, and is disposed approximately in the center of the first engagement portion 13 and the second engagement portion 14. Although the latch 22 has been explained with a configuration such that the hook portion 32*f* thereof is provided on both end sides in the Y direction of the cam portion 32, the configuration is not limited to the above.

Hereinafter, configurations of a striker 10A and a cam portion 32A according to the first modified example of the present invention; a configuration of a striker 10B according to a second modified example; a configuration of a striker 10C according to a third modified example; and a configuration of a striker 10D according to a fourth modified example, will be explained using FIG. 8 to FIG. 11.

Figure 8:
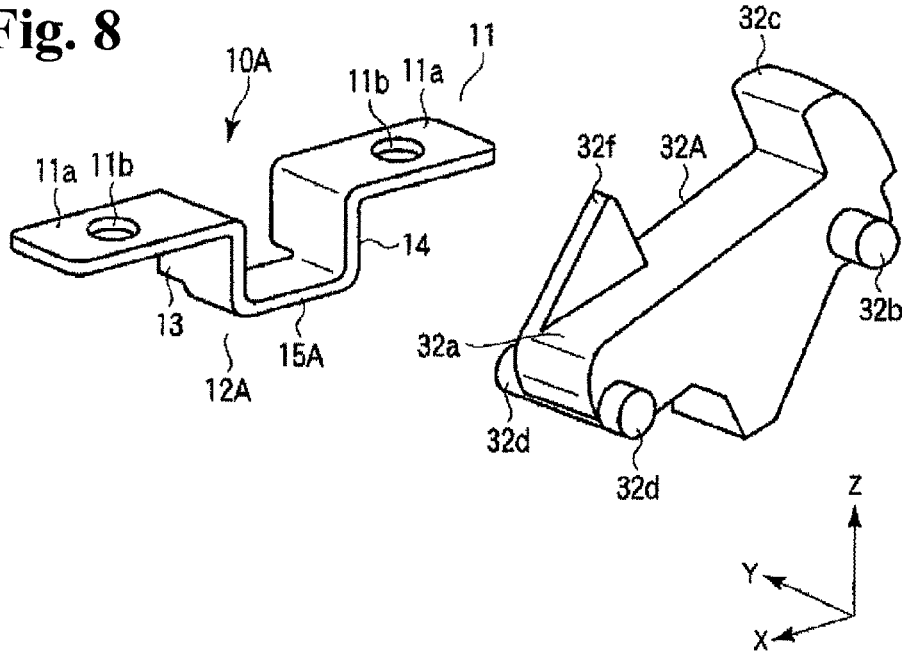
FIG. 8 is a perspective view showing configurations of a reception body and an abutment body used for the movable device according to the first modified example of the present invention.

FIG. 8 is a perspective view showing the configurations of the striker 10A and the cam portion 32A of the movable device according to the first modified example of the present invention. Incidentally, regarding the striker 10A and the cam portion 32A according to the first modified example shown in FIG. 8, the same symbols are assigned to the configurations similar to the striker 10 and the cam portion 32 according to one embodiment described hereinabove, and their detailed explanations are omitted.

As shown in FIG. 8, the striker 10A and the cam portion 32A of the movable device 1 according to the first modified example of the present invention is used for the movable device 1, and the striker 10A is fixed in the sliding door groove 104 by the fastener member in the same way as the aforementioned striker 10. The cam portion 32A is used for the latch 22 of the assist unit 20 in the same way as the aforementioned cam portion 32.

The striker 10A includes the attachment member 11, and an engagement protrusion 12A protruding in the Z direction from the attachment member 11, comprising two different faces separating in the X direction, and protruding downward from the upper frame 101. The engagement protrusion 12A includes the first engagement portion 13, the second engagement portion 14, and a connection portion 15A. In the connection portion 15A, a width in the Y direction thereof is formed shorter than the width in the Y direction of the first engagement portion 13 and the second engagement portion 14 for a width dimension in the Y direction of one hook portion 32*f*.

Also, the connection portion 15A is disposed between the first engagement portion 13 and the second engagement portion 14, and is disposed closer to one of either end side in the Y direction. Namely, the connection portion 15A is disposed on one end side on an opposite side to a side wherein the hook portion 32*f* in the Y direction is provided so as not to be positioned in a portion facing the hook portion 32*f* of the later-described cam portion 32A.

The catcher 32*a* is provided in the tip side of the cam portion 32, and includes one hook portion 32*f* protruding to an upper side of the cam portion 32A. The hook portion 32*f* is provided on one of either end side in the Y direction. Incidentally, in the striker 10A and the cam portion 32A shown in FIG. 8, the hook portion 32*f* has a configuration provided in a back side in the Y direction.

According to the movable device 1 including the striker 10A and the cam portion 32A as mentioned above, even if the cam portion 32A has a configuration including only one hook portion 32*f*, and has a configuration allowing the connection portion 15A of the striker 10A to pass through one hook portion 32*f*, the movable device 1 including the striker 10A and the cam portion 32A can provide an effect similar to the movable device 1 including the aforementioned striker 10 and cam portion 32. Incidentally, a position allowing the hook portion 32*f* to pass through may not be on one end side, and may be on a center side.

Figure 9:
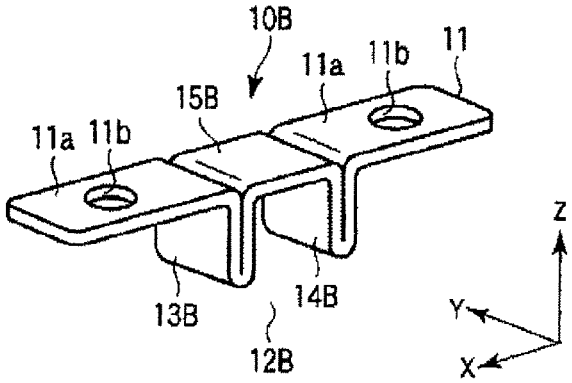
FIG. 9 is a perspective view showing the configuration of the reception body used for the movable device according to a second modified example of the present invention.

Next, as shown in FIG. 9, the configuration of the striker 10B used for the movable device 1 according to the second modified example will be explained. FIG. 9 is a perspective view showing the configuration of the striker 10B of the movable device 1 according to the second modified example of the present invention. Incidentally, in the striker 10B according to the second modified example shown in FIG. 9, the same symbols are assigned to the configurations similar to the striker 10 of the movable device 1 according to one embodiment described hereinabove, and their detailed explanations are omitted.

The movable device 1 includes the striker 10B and the assist unit 20. The striker 10B includes the attachment member 11, and an engagement protrusion 12B protruding in the Z direction from the attachment member 11, comprising two different faces separating in the X direction, and protruding downward from the upper frame 101.

The engagement protrusion 12B includes a first engagement portion 13B, a second engagement portion 14B, and a connection portion 15B. The first engagement portion 13B is formed by folding a metal plate material in two at one portion (a mid-course portion) protruding from the base 11*a* so as to protrude in a face shape from the base 11*a*. The second engagement portion 14B is formed by folding a metal plate material in two at one portion (a mid-course portion) protruding from the base 11*a*, and is a face protruding from the base 11*a*. The connection portion 15B connects the first engagement portion 13B to the second engagement portion 14B by being bent from the first engagement portion 13B and the second engagement portion 14B in such a way as to be in a face position with the base 11*a*.

Namely, in the striker 10B, the first engagement portion 13B and the second engagement portion 14B respectively protrude from the base 11*a*, and on a base 11*a* side, the first engagement portion 13B and the second engagement portion 14B are connected so as to open tip sides of the first engagement portion 13B and the second engagement portion 14B to allow the hook portion 32*f* to be inserted to pass through.

According to the movable device 1 including the striker 10B configured as above, the movable device 1 including the striker 10B can provide an effect similar to the movable device 1 including the aforementioned striker 10. Additionally, in the striker 10B, the connection portion 15B is disposed in the face position with the base 11*a* so as not to block an insertion of the abutment body between the first engagement portion 13B and the second engagement portion 14B. Consequently, the cam portion 32 including the pair of hook portions 32*f*, or the cam portion 32A including one hook portion 32*f* may be used. Also, another shape, for example, a shape wherein the hook portion and the cam portion 32 are formed in the same width may be used.

Figure 10:
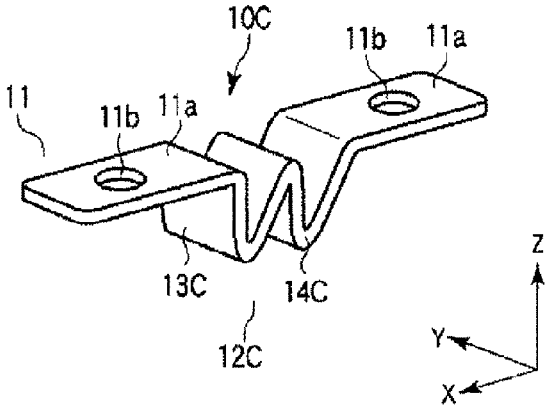
FIG. 10 is a perspective view showing the configuration of the reception body used for the movable device according to a third modified example of the present invention.

Next, as shown in FIG. 10, the configuration of the striker 10C of the movable device 1 according to the third modified example will be explained. FIG. 10 is a perspective view showing the configuration of the striker 10C used for the movable device 1 according to the third modified example. Incidentally, in the striker 10C according to the third modified example shown in FIG. 10, the same symbols are assigned to the configurations similar to the striker 10 of the movable device 1 according to one embodiment described hereinabove, and their detailed explanations are omitted.

The movable device 1 comprises the striker 10C and the assist unit 20. The striker 10C includes the attachment member 11, and an engagement protrusion 12C protruding in the Z direction from the attachment member 11, and protruding downward from the upper frame 101.

The engagement protrusion 12C includes a first engagement portion 13C and a second engagement portion 14C. The first engagement portion 13C is formed by folding a metal plate material in two at one portion (a mid-course portion) protruding from the base 11*a* in a V shape. The second engagement portion 14C is formed by folding a metal plate material in two at one portion (a mid-course portion) protruding from the base 11*a* in a V shape.

Such engagement protrusion 12C is formed in a W shape in a side view from the Y direction, and the first engagement portion 13C and the second engagement portion 14C are open (separated) to allow the hook portion 32*f* to be inserted to pass through on a lower side thereof. Also, in the first engagement portion 13C, a portion folded in two and connected to the second engagement portion 14C becomes a connection portion. Incidentally, the connection portion is positioned on the base 11*a* side more than tips of the first engagement portion 13C and the second engagement portion 14C provided that the hook portion 32*f* can be inserted to pass through.

According to the movable device 1 including the striker 100 configured as above, the movable device 1 including the striker 10C can provide an effect similar to the movable device 1 including the aforementioned striker 10B.

Figure 11:
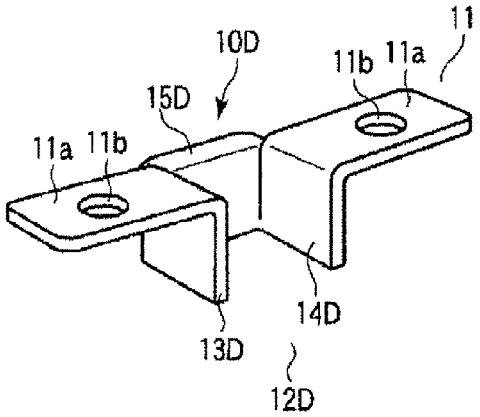
FIG. 11 is a perspective view showing the configuration of the reception body used for the movable device according to a fourth modified example of the present invention.

Next, as shown in FIG. 11, the configuration of the striker 10D of the movable device 1 according to the fourth modified example will be explained. FIG. 11 is a perspective view showing the configuration of the striker 10D used for the movable device 1 according to the fourth modified example. Incidentally, in the striker 10D according to the fourth modified example shown in FIG. 11, the same symbols are assigned to the configurations similar to the striker 10 of the movable device 1 according to one embodiment described hereinabove, and their detailed explanations are omitted.

The movable device 1 includes the striker 10D and the assist unit 20. The striker 10D includes the attachment member 11, and an engagement protrusion 12D protruding in the Z direction from the attachment member 11, comprising two different faces separating in the X direction, and protruding downward from the upper frame 101.

The engagement protrusion 12D includes a first engagement portion 13D, a second engagement portion 14D, and a connection portion 15D. The first engagement portion 13D and the second engagement portion 14D are formed by bending a metal plate material so as to protrude in a face shape from the base 11*a*. The connection portion 15D is provided to extend along the Y direction and the Z direction, and connects one lateral end portion of the first engagement portion 13D and second engagement portion 14D. The connection portion 15D is bent from the first engagement portion 13D and the second engagement portion 14D, and connects the first engagement portion 13D to the second engagement portion 14D.

Namely, in the striker 10D, by bending one sheet of plate material with a concave shape, the first engagement portion 13D and the second engagement portion 14B, which are connected to the connection portion 15D, are formed. Also, by bending one portion of the first engagement portion 13D and second engagement portion 14B, the attachment member 11 is formed. Thus, the striker 10D opens between the first engagement portion 13D and the second engagement portion 14D so as to insert the hook portion 32*f* to pass through.

According to the movable device 1 including the striker 10D as configured above, the movable device 1 including the striker 10D can provide an effect similar to the movable device 1 including the aforementioned striker 10. Additionally, in the striker 10D, the connection portion 15D has a configuration to be provided to extend along the X direction and the Z direction in such a way as to connect lateral edge portions of the first engagement portion 13D and second engagement portion 14D so as not to block the insertion of the abutment body between the first engagement portion 13D and the second engagement portion 14D. Consequently, the cam portion 32 including the pair of hook portions 32*f*, or the cam portion 32A including one hook portion 32*f* may be used. Also, another shape, for example, the hook portion and the cam portion 32 are formed in the same width, may be used.

Moreover, the striker may have a shape other than the shapes of the aforementioned strikers 10, 10A, 10B, 10C, and 10D. For example, the attachment member 11 may have a configuration wherein as one sheet of a base, the first engagement portion 13 and the second engagement portion 14 protrude from a mid-course portion thereof, and protruding tips thereof are open therebetween. In addition to this, the present embodiment can be variously modified provided that it does not exceed the subject of the present invention.

All contents of the specification, claims, drawings, and abstract of Japanese Patent Application No. 2011-093253 filed on Apr. 19, 2011 are cited in their entireties herein and are incorporated as a disclosure of the specification of the present invention.

What is claimed is:

1. A movable device for a movable body: comprising, a reception body having an attachment member fixed in either one of a support body or the movable body relatively moving to the support body, a plurality of engagement portions including a first engagement portion protruding from the attachment member, and a second engagement portion protruding from the attachment member and separated from the first engagement portion in a movement direction of the movable body, and a connection portion connecting the first engagement portion and the second engagement portion;

a base body provided in the other of the support body or the movable body;

an abutment body provided in the base body to be movable along the movement direction of the movable body, and engaging either one of the first engagement portion and the second engagement portion when the movable body moves in a movement completion position where the movable body is positioned at one end of the support body; and an urging mechanism formed between the base body and the abutment body, the urging mechanism urging the base body or the abutment body to restrict a movement of the base body or the abutment body, and releasing restriction of the movement by engagement of the abutment body with one of the first engagement portion and the second engagement portion, wherein the attachment member, the first engagement portion, the second engagement portion, and the connection portion are integrally formed, the attachment member includes a pair of bases fixed to the support body or the movable body;

the first engagement portion and the second engagement portion are formed in plate shapes, and are connected to the pair of bases, respectively; and the connection portion connects protruding tips of the first engagement portion and the second engagement portion, and one portion of the connection portion is formed to pass the abutment body.

2. A movable device for a movable body according to claim 1, wherein the attachment member, the first engagement portion, the second engagement portion, and the connection portion are formed by bending a sheet of metal material.

3. A movable device for a movable body comprising:

a reception body having an attachment member fixed in either one of a support body or the movable body relatively moving to the support body, a plurality of engagement portions including a first engagement portion protruding from the attachment member, and a second engagement portion protruding from the attachment member and separated from the first engagement portion in a movement direction of the movable body, and a connection portion connecting the first engagement portion and the second engagement portion;

a base body provided in the other of the support body or the movable body;

an abutment body provided in the base body to be movable along the movement direction of the movable body, and engaging either one of the first engagement portion and the second engagement portion when the movable body moves in a movement completion position thereof where the movable body is positioned at one end of the support body; and an urging mechanism formed between the base body and the abutment body, the urging mechanism urging the base body or the abutment body to restrict a movement of the base body or the abutment body, and the abutment body engaging the one of the first engagement portion and the second engagement portion to release restriction of the movement, wherein the attachment member, the first engagement portion, the second engagement portion, and the connection portion are integrally formed;

the attachment member includes a pair of bases fixed to the support body or the movable body;

the first engagement portion and the second engagement portion respectively protrude from the pair of bases, and are respectively folded back at mid-portions of the first engagement portion and the second engagement portion so that one portion of each of the first engagement portion and the second engagement portion is formed to be engageable with the abutment body; and the connection portion connects the first engagement portion and the second engagement portion at a position between the pair of bases and tips of the first engagement portion and the second engagement portion.

* * * * *